United States Patent [19]

Chayes

[11] 4,100,889

[45] Jul. 18, 1978

[54] BAND TYPE TUBE SUPPORT

[75] Inventor: Norman Chanine Chayes, Bloomfield, Conn.

[73] Assignee: Combustion Engineering, Inc., Windsor, Conn.

[21] Appl. No.: 785,483

[22] Filed: Apr. 7, 1977

[51] Int. Cl.[2] ..... F22B 37/24

[52] U.S. Cl. ..... 122/510; 165/162

[58] Field of Search ..... 122/476, 478, 510; 165/162, 172

[56] References Cited

U.S. PATENT DOCUMENTS

| | | | |
|---|---|---|---|
| 2,779,316 | 1/1957 | Meigs et al. | 122/510 |
| 2,859,737 | 11/1958 | Banker | 122/510 |
| 2,893,698 | 7/1959 | Nunninghoff | 165/162 X |
| 3,310,041 | 3/1967 | Hansen et al. | 122/510 |

FOREIGN PATENT DOCUMENTS

| | | | |
|---|---|---|---|
| 937,351 | 1/1956 | Fed. Rep. of Germany | 122/510 |

*Primary Examiner*—Kenneth W. Sprague
*Attorney, Agent, or Firm*—Robert L. Olson

[57] ABSTRACT

A tube support for horizontal tubes supported by vertical tubes, including lugs welded to opposite sides of the vertical tubes, and a band encircling two horizontal tubes positioned on opposite sides of the vertical support tube. The band rests on and is supported by the lugs.

1 Claim, 3 Drawing Figures

BAND TYPE TUBE SUPPORT

BACKGROUND OF THE INVENTION

In steam generators heating surface is normally disposed in the vertical rear pass leading from the furnace as a means of absorbing heat from the combustion gases passing therethrough. This surface comprises serpentine tubes through which the fluid being heated progresses either upward or downward therethrough, while either being superheated or reheated, or in the case of economizer surface the water is heated.

In small steam generators, these serpentine elements are end supported, while in larger units the supported span is too large, causing too much deflection and stress. Thus vertical support tubes are run through the rear pass on which the horizontal tube runs are supported. Some tube runs expand more than others, due to the difference in temperature of the fluid passing therethrough, or the difference in gas temperatures between the upper and lower gas pass locations. To avoid problems of over-stress caused by unequal thermal growth, it is necessary to support the horizontal tube runs from the vertical support tubes in a manner that will permit relative movement between both the horizontal and vertical tubes, and between adjacent horizontal tube runs.

SUMMARY OF THE INVENTION

The tube support of the invention includes a vertical support tube for supporting horizontal tube runs, with lugs welded to opposite sides of the vertical tubes. A metal band encircling two horizontal tube runs rests on and is supported by the lugs.

DESCRIPTION OF THE PREFERRED EMBODIMENT

Figure 1:
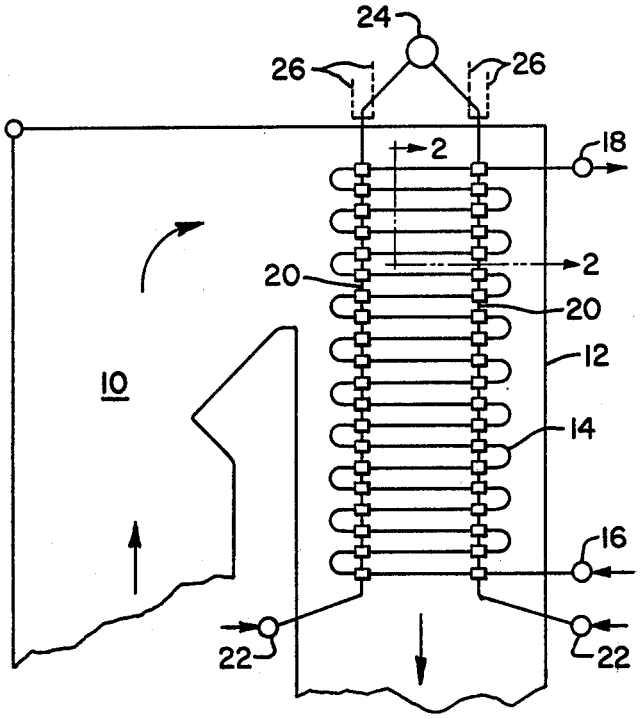
FIG. 1 is a schematic elevational section through a steam generator using the tube support arrangement of the invention.

Looking now to FIG. 1, numeral 10 designates the upper portion of a furnace of a steam generator, in which fuel is burned to generate hot combustion gases. These gases, after flowing upwardly through the furnace pass downwardly through rear gas pass 12, traversing the heat exchange surface 14 in so doing. This surface could be water heating, for example, an economizer, or it may be steam heating surface, such as a superheater or reheater. The surface is supplied with fluid from supply header 16, and after absorbing heat from the combustion gases, the fluid exits through header 18. There are a plurality of heat exchanger panels 14, which lie in side-by-side relationship across the depth of the gas pass 12.

Figure 2:
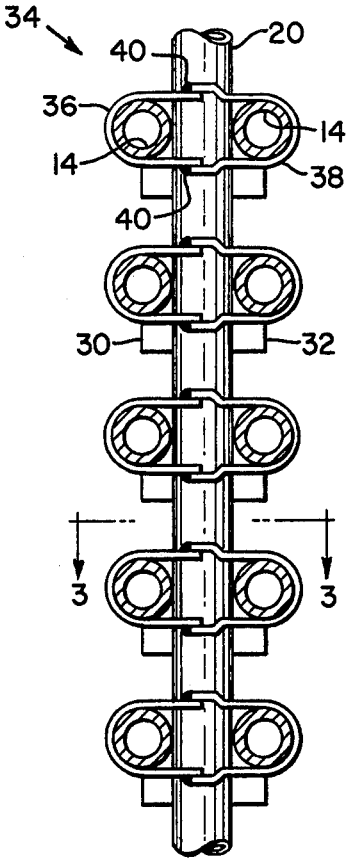
FIG. 2 is an enlarged view taken on line 2—2 of FIG. 1.
Figure 3:
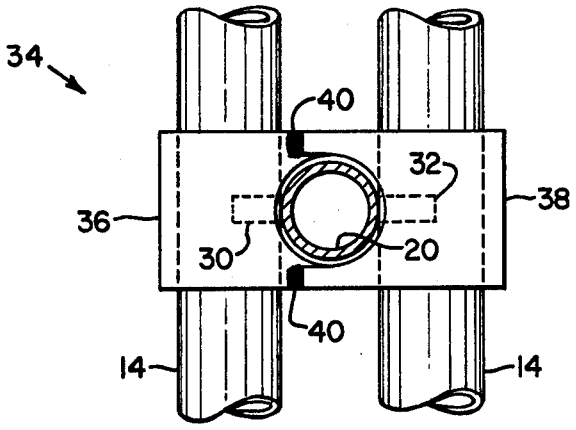
FIG. 3 is a view taken on line 3—3 of FIG. 2.

The horizontal runs of heat exchangers 14 are supported by fluid cooled vertical support tubes 20, which are supplied with cooling fluid by inlet header 22, with the fluid exiting therefrom into discharge header 24. All of the vertical support tubes 20 are supported at their upper ends by the boiler framework by means of hangers 26. Looking now to FIGS. 2 and 3 the manner in which the horizontal tube runs 14 are supported by the vertical tubes 20 is shown in more detail. A vertical support tube 20 is positioned between two closely spaced adjacent horizontal tube runs 14 such that they lightly touch one another. Each vertical tube 20 has a pair of lugs 30, 32 welded to opposite sides thereof. A metal band 34, encircles the horizontal tubes 14 on either side of vertical tube 20, and also loosely encompasses or surrounds tube 20. The band 34 rests on and is supported by the lugs 30 and 32. Each band 34 comprises two halves 36 and 38 which are welded together at 40.

From the above it can be readily seen that a support arrangement has been provided which is simple, inexpensive, and trouble-free. The only welds required on any pressure parts are the straight welds securing lugs 30 and 32 to the support tubes 20. The other welds 40 are small and easily accomplished. Because of the clearance between the band 34 and vertical tube 20 and the manner in which the band encircles horizontal tube runs 14, relative thermal growth between adjacent horizontal tube runs 14 and between the horizontal tube runs 14 and the vertical support tubes 20, is permitted without causing any undue stresses.

What is claimed is:

1. In combination, a vertical gas pass through which hot gasses flow, a heat exchanger including at least two horizontal, adjacent tube means, a tube support for the horizontal tube means including a vertical support tube positioned intermediate the two horizontal tube means, a pair of lugs, welded to opposite sides of the vertical tube, band means encircling the two horizontal tube means, the band means resting on and being supported by the lugs, said band means encompassing the vertical tube also, said band means being loose enough to permit relative movement between the two horizontal tube means, and also relative movement between the vertical tube and each of the horizontal tube means.

* * * * *